US006086847A

United States Patent [19]

Thompson

[11] Patent Number: 6,086,847

[45] Date of Patent: Jul. 11, 2000

[54] PROCESS FOR TREATING IRON-CONTAINING SULFIDE ROCKS AND ORES

[75] Inventor: Jeffery S. Thompson, Wilmington, Del.

[73] Assignees: University of Nevada; Reno Foundation on behalf of the University of Nevada, both of Reno, Nev.

[21] Appl. No.: 09/275,645

[22] Filed: Mar. 22, 1999

[51] Int. Cl.[7] ..... B01D 11/02; B01F 1/00; C22B 1/00; C22B 3/00

[52] U.S. Cl. ..... 423/659; 75/744; 75/743; 423/27; 423/29

[58] Field of Search ..... 75/743, 744; 423/27, 423/29, 150.1, 68, 49, 659, 84, 658, 5

[56] References Cited

U.S. PATENT DOCUMENTS 4,421,724 12/1983 Hunnel ..... 423/29
4,613,361 9/1986 Lamerant et al. ..... 423/27
5,587,001 12/1996 De Vries ..... 75/743

*Primary Examiner*—Steven P. Griffin
*Assistant Examiner*—Michael Rhee

[57] ABSTRACT

A process for treating ores or rocks is provided. The process comprises (1) combining the ores or rocks with an acid passivating agent to produce a first combination; (2) contacting the first combination with an aqueous solution comprising (a) manganate ions or source thereof and (b) a base whereby a second combination is produced; and (3) maintaining the pH of the second combination at about 11 to about 13.5. The process can also comprise (1) contacting the ores or rocks with the aqueous solution to produce a third combination; (2) contacting the third combination with an acid passivating agent to produce a fourth combination; and (3) maintaining the pH of the fourth combination at about 11 to about 13.5. The process can be used to prevent acid rock drainage of metal-bearing rocks or to produce a pretreated ore or rock which can further be contacted with a lixiviating agent such as, for example, sodium cyanide to extract metals such as, for example, gold and silver from the pretreated ore or rock.

16 Claims, 3 Drawing Sheets

PROCESS FOR TREATING IRON-CONTAINING SULFIDE ROCKS AND ORES

FIELD OF THE INVENTION

This invention relates to a hydrometallurgical process for treating iron-containing sulfidic ores and rocks.

BACKGROUND OF THE INVENTION

For recovering gold and/or other precious metals from ores, a number of lixiviant systems have been proposed and used over the past century. The word "lixiviate" means to extract a constituent from a solid mixture. A lixiviant system is one that contains the components necessary to extract the desired constituent. The most widely used lixiviant system for gold is a combination of sodium cyanide as ligand together with air (oxygen) as oxidant. Hydrogen peroxide is sometimes used as an auxiliary oxidizing agent. Ores that are resistant to simple extraction or lixiviation procedures are commonly referred to as "refractory" ores.

Many gold deposits in rock were created by the precipitation of gold along with sulfide minerals during the flow of hydrothermal fluids through the rock. Depending on the deposition mechanism, the sulfide minerals can be present alongside the gold or can physically encapsulate it. Over time, the zone of such deposits nearest the earth's surface will have been oxidized by weathering, and the sulfides so oxidized carried away by groundwater flow. This zone is referred to as the "oxide zone". In the deepest portions of the deposits, below the water table, the sulfide minerals remain more or less in the form in which they were deposited. This zone is referred to as the "sulfide zone". The relative size of these zones is determined by the depth of the deposit, historical water table fluctuations and surface weathering conditions, among other factors.

Where the sulfide minerals persist in such a gold deposit, they demonstrate varying degrees of reactivity to sodium cyanide, the chemical lixiviant commonly used in gold leaching, and to oxygen, consuming them and requiring the addition of fresh materials. While some iron-containing sulfide minerals such as pyrite and chalcopyrite exhibit relatively low reactivity during the time span of most gold lixiviation processes, others such as pyrrhotite are highly reactive. The added processing cost due to consumption of lixiviant chemicals by a high concentration of these highly reactive minerals can make recovery of portions or all of a gold deposit uneconomic.

In the case of gold deposits where the gold is physically encapsulated in the sulfide minerals, the minerals can create a surface barrier, which prevents the gold from being extracted. In this case, procedures such as roasting, pressure oxidation or biological oxidation of the deposit can be employed. Such procedures are very capital-intensive and costly.

In cases where the sulfide minerals do not physically block the access of the lixiviant solution to the gold, that is, the minerals are present with the gold but do not encapsulate it, an excess of lixiviant can be used, or the gold deposit can be pretreated in some way to passivate the surface of the sulfide minerals to make them less reactive to the lixiviant solution.

Certain nickel and cobalt ores also contain iron-containing sulfidic minerals such as pyrrhotite, making the ores unsuitable for cyanide leaching.

A closely related problem, known as acid rock drainage, occurs in the case of iron-containing sulfidic materials resulting from mining and leaching of various metallic and non-metallic minerals, including gold ores. These sulfidic materials include, but are not limited to, tailings, overburden, discarded waste rock removed along with ore, and unmined exposed rock such as in pit walls. The natural air/water oxidation processes described previously in relation to the surface layers of a gold deposit (the oxide zone) will also occur with these materials, causing the formation of sulfuric or related acids. These acids are the cause of severe pollution problems throughout the world. Similar problems occur with the exposed surfaces of coal mines.

U.S. Pat. No. 5,587,001 discloses a process for pretreating sulfidic iron-containing ores prior to lixiviation by contacting the ores with an aqueous solution containing manganate ions or precursor of manganate ions at a concentration between 0.0005 mole % and saturation, allowing a precursor to react to form manganese ions, and maintaining the solution pH between 6 and 13 so as to form a layer of manganese oxide on the surface of the sulfides. In scaling up this process, however, it has been found to be only marginally effective in certain cases, presumably because acid generation by the ore prevents sufficient passification of the ores' reactive surfaces.

As a result, there is a need to develop a process for effectively pretreating refractory gold or other metal deposits, which contain iron-containing sulfidic minerals that do not encapsulate the gold, to reduce the consumption of lixiviant chemicals. There is also a need for pretreating other metal deposits which contain such sulfidic minerals. While the present application centers on ores containing precious metals such as gold and silver, platinum, nickel, cobalt and other metals are also amenable to such the present invention process.

SUMMARY OF THE INVENTION

According to a first embodiment of this invention, a process that can be used for pretreating ores of metals, generally prior to lixiviating the ores, is provided. The process comprises, consists essentially of, or consists of: (A) combining an ore with an acid passivating agent to produce a first combination comprising the ore and the passivating agent; (B) contacting the first combination with an aqueous solution comprising (1) manganate ions or a precursor of manganate ions and (2) a base to produce a second combination; and (C) maintaining the pH of the second combination sufficient to effect the production of a pretreated ore wherein the acid passivating agent comprises at least one alkaline earth metal compound and optionally a second metal compound in which the metal of the second metal compound can be Ag, Cd, Ge, Mg, Pd, Pt, V, Zn, or combinations of two or more thereof.

The pretreated ore can then be contacted with a lixiviating agent under a condition sufficient to extract a metal from the ore.

According to a second embodiment of this invention, a process which can be used for treating an ore for extracting metals from the ore is provided. The process comprises, consists essentially of, or consists of: (A) contacting an ore with an aqueous solution comprising (1) manganate ions or a precursor of manganate ions and (2) a base to produce a third combination; (B) contacting the third combination with an acid passivating agent to produce a fourth combination; and (C) maintaining the pH of the fourth combination at between about 11 and about 13.5 to produce a pretreated ore wherein the passivating agent comprises at least one alkaline earth metal compound and optionally a second metal compound in which the metal of the second metal compound can be Ag, Cd, Ge, Mg, Pd, Pt, V, Zn, or combinations of two or more thereof.

The pretreated ore can then be contacted with a lixiviating agent under a condition sufficient to extract the metal present in the ore.

According to a third embodiment of this invention a process which can be used to limit acid rock drainage from a sulfidic iron-containing rock is provided. The process comprising, consists essentially of, consists of: (A) combining a rock with an acid passivating agent to produce a first combination comprising the rock and the acid passivating agent; (B) contacting the first combination with an aqueous solution comprising (1) manganate ions or a precursor of manganate ions and (2) a base to produce a second combination; and (C) maintaining the pH of the second combination sufficient to effect the production of a pretreated rock wherein the passivating agent comprises at least one alkaline earth metal compound and optionally a second metal compound in which the metal of the second metal compound is selected from the group consisting of Ag, Cd, Ge, Mg, Pd, Pt, V, Zn, or combinations of two or more thereof.

DETAILED DESCRIPTION OF THE INVENTION

Figure 1:
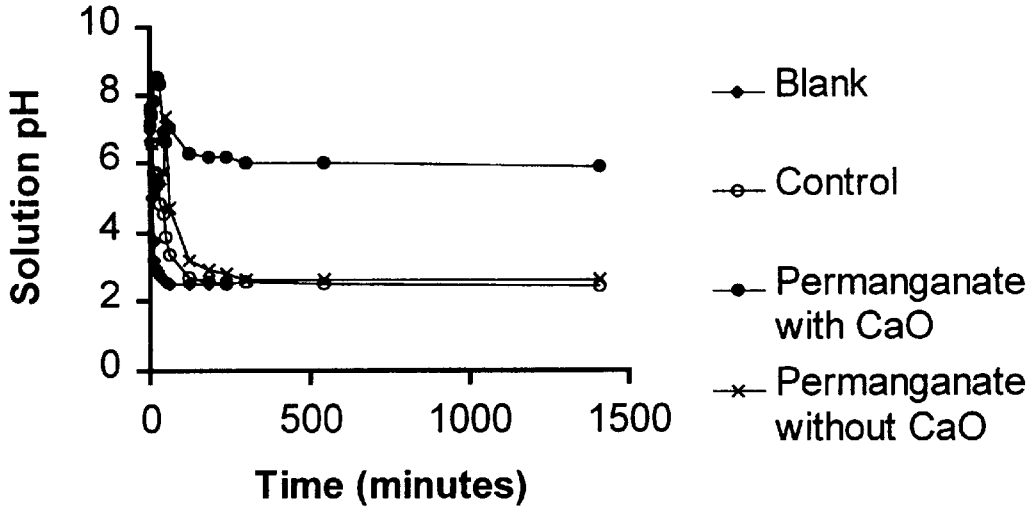
FIG. 1 illustrates the pH changes of a rock sample treated with diluted, basic permanganate solution passivated with CaO.

The processes of the present invention can be used for treating any materials containing sulfidic material. Such materials include, but are not limited to, sulfidic ore, tailings, waste rock, or combinations of two or more thereof.

In the first embodiment of this invention, iron-containing sulfidic ores of precious and other metals can be contacted with an acid passivating agent to produce a first combination. The combination can be carried out by any suitable means known to one skilled in the art such as simply placing the acid passivating agent on top of the ores, mixing, blending, or combinations of two or more thereof. The passivating agent is selected from the group consisting of alkaline earth metal compound, a second metal compound, and combinations thereof. The metal of the second metal compound can be Ag, Cd, Ge, Mg, Pd, Pt, V, Zn, or combinations of two or more thereof.

Generally, any alkaline earth metal compound can be used as long as the compound can substantially maintain a solution pH for the passivation of the generation of acid. The presently preferred alkaline earth metal compound is an alkaline earth metal oxide or alkaline earth metal hydroxide. Examples of suitable alkaline earth metal compounds include, but are not limited to, magnesium oxide, calcium oxide, strontium oxide, barrium oxide, magnesium hydroxide, calcium hydroxide, and combinations of two or more thereof. Among these metal compounds, magnesium oxide and calcium oxide are most preferred for they are readily available, relatively soluble in an aqueous medium, and inexpensive.

Generally, the second metal compound is substantially soluble in a solution having a pH of 11 or higher. The second metal compound can be a metal oxide or any metal salt. The metal of the presently preferred second metal compound is Ag, Cd, Mg, Pd, Zn, or combinations thereof. The term "solution" used herein can also include insoluble salts. The term "substantially" means more than trivial. The term "passivation" or "passivating" used herein refers to the process of making a material passive. A material is passive if it resists corrosion or reaction in a given environment despite a marked thermodynamic tendency to react (H. H. Ulig and R. W. Revie, "Corrosion and Corrosion Control", Jon Wiley and Sons, New York, N.Y., 1985, p.61).

The contacting time can be from about 1 second to about 10 hours under ambient conditions.

In the second step of the process, the first combination produced is contacted with an aqueous solution comprising (1) manganate ion ($MnO_4^{=}$) or a source of manganate ion and (2) a base to produce a second combination. The term "source of manganate ion" refers to any precursor that under reaction conditions leads to the formation of manganate ion. Thus, these sources of manganate ion can include inorganic permanganate compounds. The preferred source of manganate ion for use in the process of the present invention is potassium permanganate.

The amount of manganate ion or a source of manganate ion required is generally a manganese oxide-forming amount that can form an adherent layer of manganese oxide on the iron-containing sulfidic mineral. The manganese oxide-forming amount can range from about 0.0005 mole % to saturation of manganese ions. A preferred range of manganese ions is from about 0.0012 mole % to about 0.12 mole %. Depending on conditions, these manganese ions can be present as manganate ($MnO_4^{=}$) ions, permanganate ($MnO_4^{-}$) ions, hypomanganate ($MnO_4^{-3}$) ions or combinations thereof. Manganate ion and permangante ion are also referred to as manganese ion(s) in this application. Suitable conditions for formation of the adherent layer containing manganese oxide include control of the pH of the second combination.

The pH range of the second combination is preferably maintained at between about 11 to about 13.5 so as to form an adherent layer of manganese oxide on the iron-containing sulfidic mineral. The preferred pH range of the aqueous solution during this process is about 11.5 to about 13. It is important to control the pH of the second combination, particularly in the period after the initial contacting of the ore or rock, which is disclosed in the third embodiment of this invention, with the aqueous solution. Generally, a sufficient amount of base is added so as to maintain the pH of the second combination.

According to the present invention, any bases, organic or inorganic bases, that can maintain the pH of the second combination sufficiently high to effect the formation of a layer of manganese oxide on the surface of the iron-containing sulfidic mineral, can be used. The presently preferred bases are inorganic bases such as, for example, lithium hydroxide, sodium oxide, potassium oxide, sodium hydroxide, potassium hydroxide, cesium oxide, cesium hydroxide, and combinations of two or more thereof. The presently preferred base is sodium hydroxide because it is readily available and inexpensive.

Wishing not to be bound by theory, the need for pH control arises from the chemistry of the intermediates formed during the reduction of permanganate ions, as shown in the equation below:

$$MnO_4^{-} \rightarrow MnO_4^{-2} \rightarrow MnO_4^{-3} \rightarrow MnO_2$$

This process requires three one-electron reductions of permanganate to a Mn(IV) oxide. The intermediates MN(VI) oxide and Mn(V) oxide are not stable below pH 12. These ions undergo disproportionation reactions that initially form a colloidal manganese dioxide and finally a manganese dioxide precipitate (A. H. Reidies, "Ullmann's Encyclopedia of Industrial Chemistry", 5th Ed., Vol. A16, 1990; pp. 123–143; K. Pisarczyk, "Kirk-Othmer Encyclopedia of Chemical Technology", 4th Ed., Vol. 15, 1995; pp. 991–1055).

The sulfidic ore, tailings, and waste rock to be treated with permanganate and derivatives are generally acidic owing to the sulfuric acid generation from sulfide oxidation, adding to the problem and requiring either an initial excess of alkali over that first required, or continued pH measurement and control during processing.

The treated ore can then be contacted with a lixiviating agent under a condition sufficient to extract the metal present in the ore, using any lixiviating agent and under any conditions known to one skilled in the art. Generally, lixiviant agents useful in the hydrometallurgical process of the present invention include ferric chloride and cyanide. However, any lixiviant systems in which the lixiviant agent reacts with sulfides can be utilized in the process of the present invention. Because the treatment of an ore with a lixiviating agent and conditions thereof are well known to one skilled in the art such as that disclosed in U.S. Pat. No. 5,587,001 (disclosure of which is incorporated herein by reference), the description of which is omitted herein for the interest of brevity.

The materials treatable by the present invention can contain any of several iron-containing sulfidic minerals. Examples of such minerals include, but are not limited to, pyrrhotite, bornite, chalcopyrite, arsenopyrite, pyrite and combinations of two or more thereof. Treatable ores are characterized by the presence of iron and sulfur in its reduced form, generally sulfide, and by the fact that the gold or other metal in the treatable ores is not sulfide encapsulated.

Wishing not to be bound by theory, it is believed that manganate ions or permanganate ions react with the sulfides in the iron-containing sulfidic gold or other metal ore to form a manganese oxide layer over the surface of the sulfide as shown by X-ray photoelectron spectroscopy (XPS). This layer, presumably composed of manganese dioxide, is relatively non-reactive to lixiviant systems and shields the sulfide from reaction with the lixiviant system. By appropriate control of pH and manganese ions concentration, the resulting manganate ions can deposit a firm (non-gelatinous) adherent coating, as manganese oxide, on these iron-containing sulfidic minerals.

Also wishing not to be bound by theory, it is believed that the passivation of the sulfide surface is accomplished by the generation of a protective layer of manganese dioxide on the surface, during the contacting of the aqueous solution and the first combination in which vigorous agitation could displace or disrupt the protective layer is preferably avoided. Moderate agitation is generally acceptable practice during passivation, but once lixiviation has begun, agitation is preferably minimal to preserve the integrity of the coating formed on the surface.

The required contact time between the iron-containing sulfidic material and the aqueous solution containing the manganate ion or the source of manganate ion generally depends on the nature of the material. In practice, for any ore of interest, this time can be readily determined by application of the procedure of Examples disclosed hereinbelow, using different manganate exposure times. Generally, the minimal time period can be about 1 minute, preferably about 10 minutes. There is no upper time limit except as established by the economies of operation. The process of this invention can be carried out at temperatures above the freezing point of the aqueous solution used in the second step.

According to the first embodiment of this invention, the production of magnesium oxide layer over sulfides is generally substantially complete before the introduction of the lixiviation system. While the benefits of shielding and passivating the iron-containing minerals can be maintained whether or not the manganate and permanganate ions are substantially removed at this point, their removal is preferred because they can react with and consume part of the reagents of the lixiviation system.

The process of the present invention can make certain uneconomical gold or other metal deposits economical for metal recovery by significantly reducing reagent costs. Not only can cyanide consumption be decreased, but oxygen consumption can be also decreased. These cost benefits can extend the life of a mining operation by increasing the portion of metal deposits which can be economically recovered. Additional benefits of the present invention can include an increase in leach rate due to the fact that oxygen consumption is reduced and an increase in safety in that the passivation of the sulfides slows possible acidification of the cyanide leach liquor and, hence, the potential for volatilization of cyanides as HCN gas.

Iron-containing sulfidic minerals can be treated by the process of the present invention for a variety of other purposes. For example, the tailings, waste rock and other exposed surfaces at mining operations can react with atmospheric air and surface water over a period of time, as described previously in the formation of the oxide zone of gold deposits, forming destructive and polluting acid drainage. Formation of a manganese oxide-containing coating on the iron-containing sulfides to shield them from lixiviant reagents can also shield these materials from atmospheric air or surface water containing oxygen to prevent or minimize acid drainage problems.

According to the second embodiment of this invention, a process which can be used to treat an iron-containing sulfidic ore is provided. The first step comprises contacting the ore with an aqueous solution which comprises (1) manganate ions or a precursor of manganate ions and (2) a base whereby a third combination is produced. The definition, scope, and quantity of manganate ions, precursor of manganate ions, and base are the same as those disclosed above in the first embodiment of this invention.

The contacting is generally carried out under a condition that is sufficient to produce the third combination having a pH in the range of about 11 to about 13.5, preferably about 11.5 to about 13. It can be carried out under ambient conditions for about 1 second to about 10 hours, or longer.

In the second step, the third combination is contacted with an acid passivating agent to produce a fourth combination. The definition, scope, and quantity of acid passivating agent are the same as those disclosed in the first embodiment of this invention. The contacting can be carried out under ambient condition for about 10 minutes to about 20 hours or longer to sufficiently produce a combination having the pH which can be maintained at about 11 to about 13.5, as disclosed in the third step.

Maintaining pH at about 11 to about 13.5, preferably about 11.5 to about 13, can be carried out by any means known to one skilled in the art such as, for example, addition of sodium hydroxide. Because maintaining pH at a specific range is well known to one skilled in the art, description of which is omitted herein.

The third step is generally carried out for a time period sufficient to contact the passiviating agent with the sulfidic material such as, for example, from 1 second to as long as 10 hours or even longer. The treated ore can then be contacted with a lixiviating agent as disclosed hereinabove. Metals in the treated ore slurry can then be extracted by contacting the treated ore with the lixiviating agent.

According to the third embodiment of the invention, a process which can be used for limiting acid rock drainage from an iron sulfide containing rock is provided. The first step of the process comprises contacting the rock with an acid passivating agent to produce a first mixture. In the next step, the first mixture is then contacted with an aqueous medium comprising (1) manganate ions or a precursor of manganate ions and (2) a base to produce a second mixture. The pH of the second mixture is generally maintained at about 11 to about 13.5, preferably about 11.5 to about 13.

Alternatively, the third embodiment can be carried out by first contacting the rock with the aqueous solution to produce a third mixture. In the next step, the third mixture is contacted with an acid passivating agent to produce a fourth mixture. The pH of the fourth mixture is generally maintained at about 11 to about 13.5, preferably 11.5 to 13.

The acid passivating agent and the aqueous medium are the same as those disclosed above in the first embodiment of this invention. The quantity of the acid passivating agent and the aqueous medium are also the same as those disclosed in the first embodiment of this invention. Similarly, the contacting of the rock with an acid passivating agent and the contacting of the first mixture with an aqueous solution can be the same as the contacting of the ore with an acid passivating agent and the contacting of the first combination with an aqueous solution, respectively. The contacting of the rock with an aqueous solution and the contacting of the third mixture can be the same as the contacting of an ore with an aqueous solution and the contacting of the third mixture with an acid passivating agent, respectively. The pH of the second or fourth mixture is also maintained at about 11 to about 13.5, preferably about 11.5 to about 13.

The following examples are provided to further illustrate the process of this invention and are not to be construed as to unduly limit the scope of this invention.

EXAMPLE 1

Passivation of Waste Rock to Acid Generation

In this example, a waste rock sample was treated with dilute, basic permanganate solution, and the effect on acid generation potential of the material was evaluated by monitoring changes in solution pH following addition to an aqueous hydrogen peroxide solution.

Sample Mineralogy

The sample was a pyritized and moderately silicified rhyolite or rhyolitic tuff. The material consisted of about 15% euhedral or broken phenocrysts of K- and Na-feldspar set in a fine-grained groundmass, which appeared to have originally consisted of quartz, feldspar, and glass shards. Both phenocrysts and groundmass were partly replaced by secondary silica. Traces of monazite and rutile were also present in the groundmass. The sample contained 1–2 weight percent pyrite, as pyritohedra averaging about 70 $\mu$m in maximum dimension. A single grain of colloform pyrite was also observed. An amount of galena and acanthite was observed, included in pyritohedral pyrite. A few grains of an Al-Pb-$PO_4$ phase, which may be plumbogummite, were also found in fine-grained intergrowths with secondary silica. Pyritohedra and micro-porosity were distributed secondary silica. Pyritohedra and micro-porosity were distributed along a single preferred direction.

Reagents and Instrumentation

Ion chromatography-grade water from a Barnstead Nanopure water system (Barnstead Thermolyne Corporation, 2555 Kerper Blvd., Dubuque, Iowa 52001 USA) was used to prepare all solutions and to clean all glassware and other laboratory apparatus. Potassium permanganate, calcium oxide, and sodium hydroxide solution were reagent grade or better. Reagent grade 30% hydrogen peroxide was used in peroxide tests (EM Science, 480 S. Democrat Road, Gibbstown, N.J. 08027).

Sulfate analyses were performed with a Dionex DX-300 Gradient Chromatography System with AI-450 Chromatography Software and Ionpac AS4A-SC analytical column with 1.8 mM sodium carbonate/1.7 mM sodium bicarbonate eluent (Dionex Corporation, 1228-T Titan Way, P.O. Box 3603, Sunnyvale, Calif. 94088). Solution pH values were measured with a Fisher Accumet pH meter Model 815MP Fischer Scientific, 711 Forbes Avenue, Pittsburgh, Pa. 15219-4785).

Procedure

In this example, three samples were prepared. A control sample was treated with an aqueous solution at the same pH as the permanganate samples. There were two permanganate treated samples. One sample had the pH of the passivating solution maintained at 12 until the color of the manganese species (Mn(VII), Mn(VI), and Mn(V) oxides) disappeared. The second permanganate sample had no pH control.

The control solution was prepared by diluting 2.5 ml of 1 N NaOH to 100 ml. The pH of this solution was 12.3.

A potassium permanganate solution was prepared in the following manner. Potassium permanganate (0.05 g) was dissolved in 80 ml of water in a beaker with stirring. To this solution was added 2.5 ml of 1 N NaOH to yield a solution pH of 12.29. The solution was transferred to a 100 ml volumetric flask and diluted to volume.

To three jars was added 10 g of sample. To two jars was added 0.020 g CaO. Water (40 ml) was added to all three jars. To the control sample, one of the samples with CaO, were added 5 ml of the control solution and 5 ml of water. The pH of this solution was 12.08. To the second jar with CaO were added 5 ml of the potassium permanganate solution and 5 ml of water; the pH of this solution was 12.2. No adjustment was needed. To the remaining jar, with no CaO, were added 5 ml of permanganate solution and 5 ml of water. The pH of this solution was 11.42. No adjustment was made.

When the color faded from the permanganate samples, the rock sample was collected by filtration and washed with 300 ml of water. The permanganate sample with CaO required 10 minutes for disappearance the color. The control sample was collected at this time. The second permanganate sample required 1 hour for disappearance of the color; the sample was collected and washed in the same manner. The solution of the passivating solution was 11.02.

Peroxide Test

The method for this test is a modification of a literature procedure (R. B. Finkelman and D. E. Giffin, Recreation and Revegetation Research, 5, 521–534, 1986). A sample was added to a 250-ml beaker. Water (85 ml) and 30% hydrogen peroxide (15 ml) were then added. The solution pH was measured immediately. The pH was then measured every 5 minutes for 0.5 hour, then every 10 minutes for another 0.5 hour, and then every hour for an additional 5 hours. The samples were allowed to stand overnight at room temperature for a final pH reading. After the final reading, the sample was filtered. The sulfate concentration of the solution was determined by ion chromatography.

Results

The changes in solution pH during the peroxide test are shown in FIG. 1. Four samples were analyzed, the three samples described above and a blank sample, which received no treatment. The blank, control, and permanganate sample without CaO rapidly showed significant acid generation. The solution pH fell to values below 3 in three hours or less; these acidic pH values indicate strong acid generation potential for all three samples. The sample with the pH maintained at 12 during the passivation step showed no acid generation; the relatively high pH at the end of the test indicates no acid generation potential in this sample.

Sulfate concentrations, obtained by analysis of the sulfate concentration in solution at the end of the peroxide test, are shown in Table 1. The sample passivated in the presence of CaO showed substantially lower sulfate in solution compared with sample treated with permanganate in the absence of CaO. Both the solution pH and sulfate concentration were very similar for the blank, control, and sample treated with permanganate without CaO. Treatment with a basic permanganate solution alone was not effective.

TABLE 1

Sulfate Concentrations from Example 1

| Sample | Sulfate Concentration, mM |
|---|---|
| Blank | 19.6 |
| Control | 27.9 |
| Passivated Sample with no CaO | 20.6 |
| Passivated Sample with CaO | 3.5 |

EXAMPLE 2

Passivation of Tailings to Acid Generation

In this example, ore tailings from a gold operation were treated with dilute, basic permanganate solution and the effect on acid generation potential was evaluated by monitoring changes in solution pH following addition to an aqueous hydrogen peroxide solution.

Sample Mineralogy

The gangue minerals in the sample consisted of major quartz, chlorite, and iron oxide with trace amounts of rutile and an apatite-group mineral. The sample contained approximately 15 weight percent sulfide, which was almost entirely pyrrhotite. Only a small amount of pyrite was observed. The sulfide was completely liberated, with an average grain size of 30 $\mu$m.

Reagents and Instrumentation

Reagents and instrumentation were identical to above example.

Procedure

The general procedure was the same as in Example 1. To each of three jars was added 10 g of sample. To two jars was added 0.020 g CaO. Water (40 ml) was added to all three jars. To the control sample, one of the samples with CaO, was added 5 ml of the control solution and 5 ml of water. The pH of this solution was 11.58; the pH was adjusted to 12.10 with 1 N NaOH. To the second jar with CaO was added 5 ml of the potassium permanganate solution and 5 ml of water; the pH of this solution was 11.63; the solution pH was adjusted to 12.07 with 1 N NaOH. To the remaining jar, with no CaO, was added 5 ml of permanganate solution and 5 ml of water. The pH of this solution was 10.25. No adjustment was made.

When the color faded from the permanganate samples, the rock sample was collected by filtration and washed with 300 ml of water. The permanganate sample with CaO required 10 minutes for the disappearance of the color. The control sample was collected at this time. The second permanganate sample required 0.5 hour for disappearance of the color; the sample was collected and washed in the same manner. The solution pH of the filtrate from this sample was 8.34.

Peroxide Test

The peroxide test method described in Example 1 was used.

Results

Figure 2:
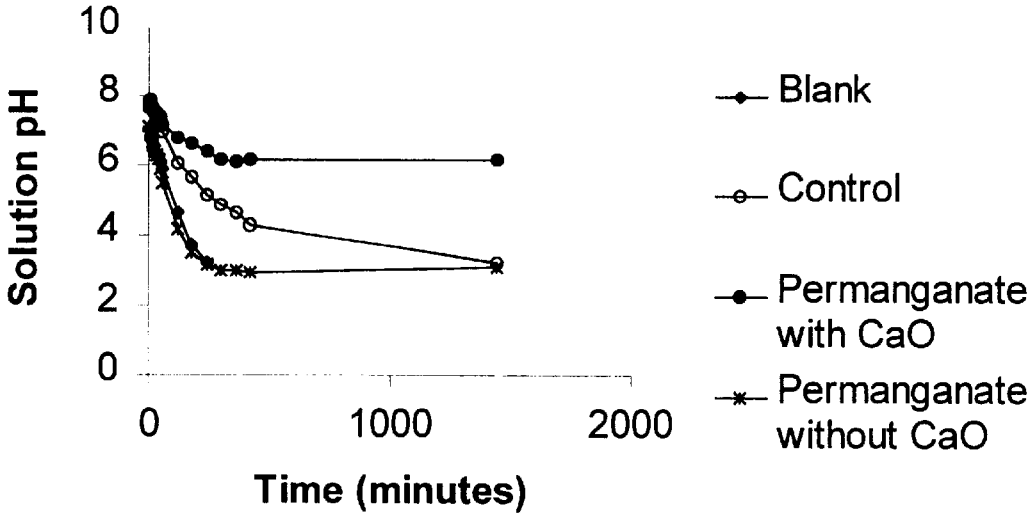
FIG. 2 illustrates ore tailings from a gold operation treated with permanganate solution passivated with CaO.

The changes in solution pH during the peroxide test are shown in FIG. 2. Four samples were analyzed, the three samples described above and a blank sample to which nothing was done. The blank, control, and permanganate sample without CaO rapidly showed significant acid generation. The final solution pH values of these samples indicated significant acid generation potential. The solution pH fell to acidic values in three hours or less. The sample with CaO had the pH maintained at 12 during the permanganate treatment and showed no acid generation over the length of the test. The final solution pH value indicated no acid generation potential of the permanganate treated sample at a pH of 12.

EXAMPLE 3

Passivation of Gold Ore Sample Prior to Cyanide Leaching

In this example, a gold ore with significant pyrrhotite content was treated with dilute, basic permanganate solution and the effect on sodium cyanide consumption of the material was evaluated by determination of cyanide concentrations following contact with the ore.

Sample Mineralogy

Free gold is associated with a gangue consisting of chlorite and quartzite. The sample contained approximately 10 weight percent sulfide, which was almost entirely arsenopyrite and pyrrhotite. The pyrrhotite content was quite variable.

Reagents and Procedures

In these studies, 2 1-liter glass columns (Kimax) were used to handle 250–500 g charges of sulfide sand. A sulfide sand sample (80% passing 100 mesh) was collected from cyclone overflow in the grinding circuit of the gold plant and dewatered in a filter press. Potassium permanganate was certified A. C. S. grade from Fisher Scientific. Water used in these studies was plant water and water from a reverse osmosis water unit, which will be referred to as deionized water in the following discussions. Deionized water was used to prepare cyanide solutions and to wash pH probes and glassware. Solution pH adjustments were made with sodium hydroxide pellets or lime.

Cyanide determinations were by titration with silver nitrate in the presence of potassium iodide. The end-point was detected by the persistence of turbidity (G. H. Jeffery, J. Bassett, J. Mendham, and R. C. Denney, "Vogel's Textbook of Quantitative Chemical Analysis", $5^{th}$ ed., Longman Scientific and Technical: Essex, England, 1989, p.358.). In this procedure, 20 ml of sample was mixed with 5 drops of KI solution; this mixture was titrated with silver nitrate. No ammonia was added to the sample as stated in the literature procedure.

Charges of sand (250 g) were added to glass columns in the following manner. Each charge was mixed with 0.88 g lime. The charge was then pressed through a piece of window screening into 200 ml of solution. For the control sample, this solution was plant water. For the permanganate treated sample, this solution was 0.07 g KMnO4 dissolved in 200 ml plant water; no pH adjustment was made to this solution. This procedure was used to ensure good contact of the fine ore particles with the solution. The columns were allowed to stand 0.5 hours after addition was complete. The columns were then drained.

To each column was added 50 ml of 650 parts per million by weight (ppm) NaCN (by titration with silver nitrate) with the stopcock closed. The columns were then drained. A second 50-mL aliquot was added. The columns were drained until the level of the NaCN solution in the column was level with the top of the bed. The stopcock was closed. The columns were allowed to stand for one hour. At this time, an additional 50 ml of NaCN solution was added, and the columns then were drained to the same level. The effluent was collected and measured. The pH and cyanide concentration were then determined.

A second permanganate-treated column was prepared in the same manner with the following change: 0.5 g of lime in place of 0.88 g. The pH of the resulting slurry was 11.5. The data are shown in Table 2. These column tests established that pretreatment of the gold ore with a potassium permanganate at pH 12 significantly reduced cyanide consumption from reaction with pyrrhotite. Passivation simply required contacting the slurry with permanganate solution at the proper solution pH. The sample with 0.88 g of lime showed a sodium cyanide concentration 100–200 ppm higher than the control (Table 2). The pH of the slurry was about 12 during the passivation step. The sample treated with permanganate at a lower pH with 0.50 g lime showed only a marginal difference from the control sample. The pH of this slurry was about 11 to about 11.5 during the permanganate treatment.

TABLE 2

Sodium Cyanide Concentrations from Example 3

| | Vol of Effluent (ml) | Solution pH | NaCN Concn (ppm) |
|---|---|---|---|
| Control Time (Hour) | | | |
| 1 | 52.40 | 11.68 | 325 |
| 2 | 52.40 | 11.81 | 450 |
| 3 | 44.20 | 11.54 | 500 |
| 4 | 46.80 | 11.49 | 475 |
| Passivated with 0.88 g lime Time (Hour) | | | |
| 1 | 54.00 | 11.65 | 525 |
| 2 | 47.00 | | 537 |
| 3 | 48.00 | 11.63 | 537 |
| 4 | 46.00 | 11.63 | 575 |
| Passivated with 0.50 g Lime Time (Hour) | | | |
| 1 | 50.60 | 11.64 | 400 |
| 2 | 58.60 | 11.58 | 450 |
| 3 | 49.60 | 11.56 | 500 |

EXAMPLE 4

Passivation of Pyrite to Acid Generation in the Presence of Magnesium Oxide

In this example, pyrite was treated with dilute, basic permanganate solution with and without magnesium oxide. The effect of this treatment on the acid generation potential of pyrite was evaluated by monitoring changes in solution pH following addition of an aqueous peroxide solution.

Sample

Pyrite was obtained from Ward's Natural Science Establishment, Inc. (P. O. Box 92912, Rochester, N.Y.). Sample was crushed to −10/+20 mesh. The sulfide was cleaned before use by soaking the crushed sample in 3 M HCI for at least 36 hours (reference: V. S. T. Ciminelli and K. Osseo-Asare, Metallurgical and Materials Transactions B, 26B, 209–218, 1995). Solids were collected on a frit, washed with water, and briefly air dried. Sample was stored in water until needed.

Reagents and Instrumentation

Reagents and instrumentation were identical to Example 1.

Procedure

The general procedure was the same as in Example 1. To each of three 50-ml beakers was added 1.0 g of pyrite. To one beaker were added 0.010 g CaO and 0.005 g MgO. To the other two beakers was added 0.010 g CaO. To each beaker was added 15 ml of water. The solution pH was adjusted to 12 with 1 N NaOH.

Permanganate and control solutions were prepared as described in Example 1. To a beaker with CaO and the beaker with both CaO and MgO was added 5 ml of potassium permanganate solution; to the third beaker was added 5 ml of control solution. The samples were allowed to soak in the solution for two hours. The pH was measured every 15 minutes and adjusted to 12 with 1 N NaOH as needed. The samples were collected and washed as described in Example 1.

Peroxide Test

The peroxide test method described in Example 1 was used here.

Results

Figure 3:
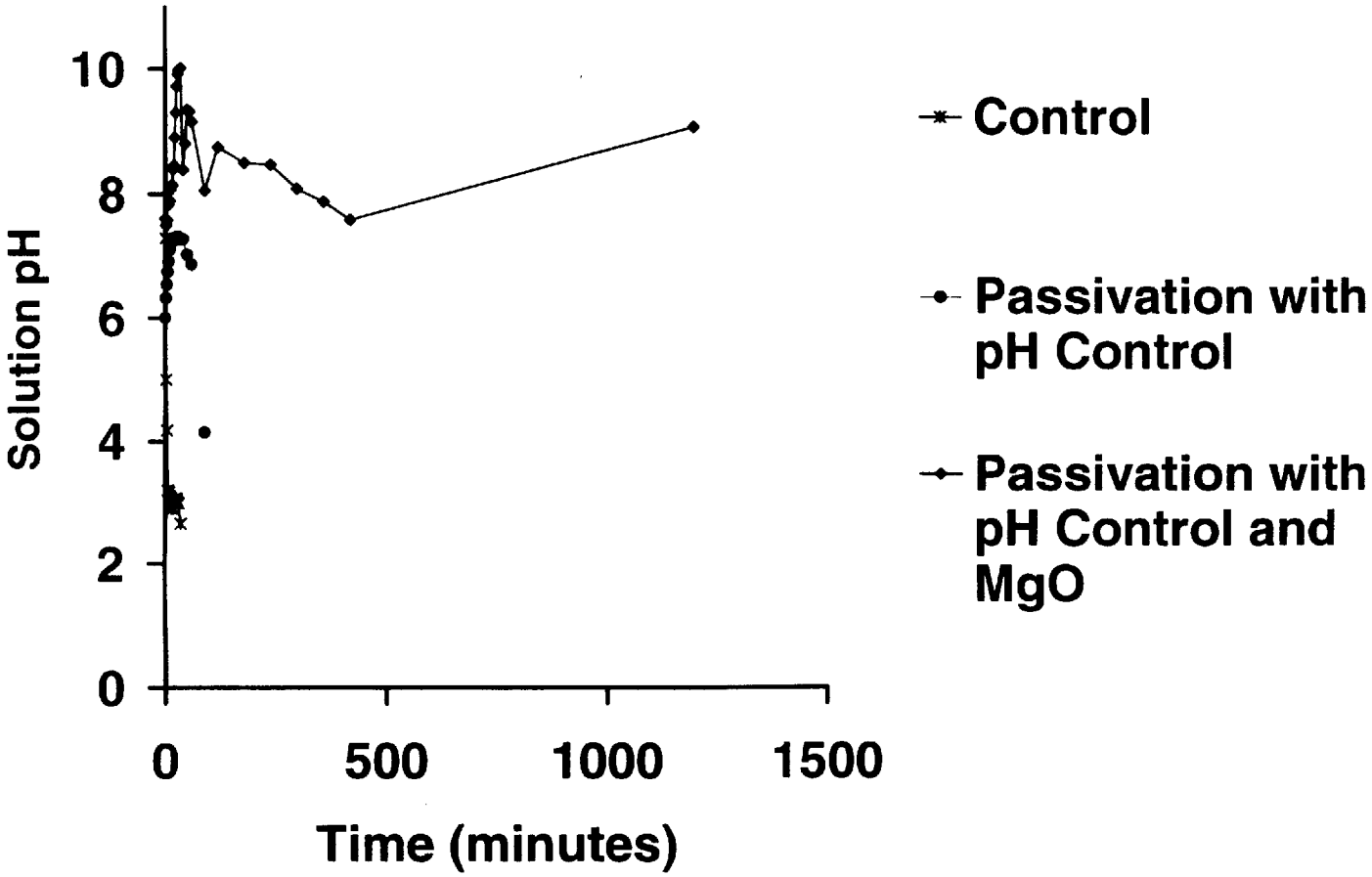
FIG. 3 illustrates the potential acid generation of pyrite treated with permanganate solution passivated with MgO.

The changes in solution pH during the peroxide test are shown in FIG. 3. The control and permanganate sample with CaO rapidly showed significant acid generation. The control sample generated acid immediately whereas the permanganate-treated sample with CaO required approximately an hour before acid generation became significant. The final solution pH values of these samples indicated significant acid generation potential. The sample with both CaO and MgO showed no acid generation over the length of the test. The final solution pH value (9.1) indicates no acid generation potential for the treated sample with basic permanganate solution in the presence of magnesium salt.

These results were supported by analytical results from determination of the sulfate concentration in the peroxide solutions at the end of the peroxide test. Sulfate concentrations are shown in Table 3. Both the blank and control samples produced significant amounts of sulfate ion, indicating oxidation of sulfide material. The sample passivated with CaO alone showed a smaller amount of sulfate; note that the peroxide test was stopped after 90 minutes because the sample was already acid. The sample treated with permanganate solution with both CaO and MgO showed no acid generation and only a very low sulfate concentration over the length of the test. This treated pyrite sample showed no acid generation potential.

TABLE 3

Sulfate Concentrations from Example 4

| Sample | Reaction Time, minutes | Final pH | Sulfate Concentration, mM |
|---|---|---|---|
| Blank | 90 | 2.54 | 25.0 |
| Control | 1200 | 2.56 | 23.2 |
| Passivated Sample with CaO | 90 | 3.12 | 4.3 |
| Passivated Sample with CaO and MgO | 1200 | 9.07 | 1.1 |

EXAMPLE 5

Passivation of Waste Rock to Acid Generation

In this example, a waste rock sample was treated with dilute, basic permanganate solution with and without magnesium oxide. The effect on the acid generation potential of the material was evaluated by monitoring changes in solution pH following addition of an aqueous peroxide solution.

Sample Mineralogy

The sample was a silica-cemented quartzite, containing minor K-feldspar and trace amounts of monazite, zircon, and several sulfide minerals. Sulfides consisted largely of pyrite, as well as a few grains of chalcopyrite, and single grains of arsenopyrite and sphalerite. Most sulfide grains were smaller than 50 $\mu$m in maximum dimension, and overall sulfide content was less then 0.5 weight percent. Sulfides were distributed along zones of porosity. The zones did not appear continuous. This material was capable of generating acid, because of the presence of sulfides and absence of any natural neutralizing capacity.

Reagents and Instrumentation

Reagents and instrumentation were identical to Example 1.

Procedure

The general procedure were the same as in Example 1. To three 50-ml beakers was added 10 g of sample and 0.010 g CaO. To one sample was added 0.005 g MgO. Water (15 ml) was added to all three beakers. To the control sample was added 5 ml of the control solution. The pH of this solution was adjusted to 12.10 with 1 N NaOH. To the second sample with CaO alone was added 5 ml of the potassium permanganate solution; the pH of this solution was adjusted to 12.08 with 1 N NaOH. To the remaining sample, with both CaO and MgO, was added 5 ml of permanganate solution. The pH of this solution was 12.32. No adjustment was made. When the color faded from the permanganate samples, the rock samples were collected by filtration and washed with 300 ml of water. The control sample was collected at this time.

Peroxide Test

The peroxide test method described in Example 1 was used here.

Results

Figure 4:
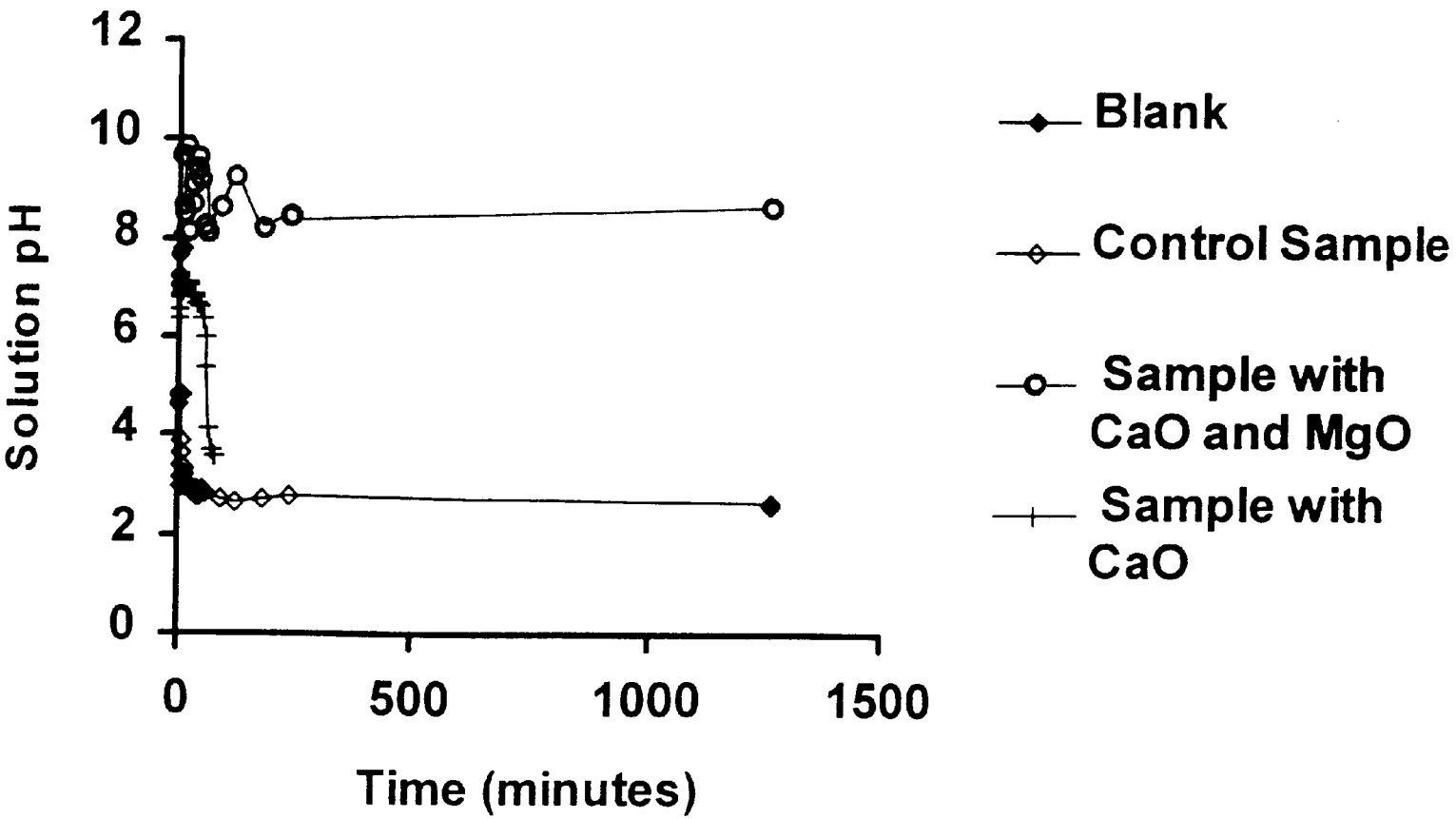
FIG. 4 illustrates the treatment of a waste rock with permanganate solution passivated with CaO and MgO.

The changes in solution pH during the peroxide test are shown in FIG. 4. Four samples were analyzed, the three samples described above and a blank sample, which had no pretreatment. The blank, control, and permanganate sample with CaO alone rapidly showed significant acid generation; there was virtually no difference in acid generation between the control sample and that treated with permanganate in the presence of CaO alone. The final solution pH values of these samples indicate significant acid generation potential. The sample with permanganate solution in the presence of both CaO and MgO showed no acid generation over the length of the test. The final solution pH value indicated no acid generation potential of the permanganate treated sample when a magnesium salt was included.

What is claimed is:

1. A process comprising: (1) contacting a metal-containing material with an acid passivating agent to produce a first combination; (2) contacting said first combination with an aqueous solution which comprises (a) manganate ions or a precursor of manganate ions and (b) a base to produce a second combination; and (3) maintaining the pH of said second combination in the range of about 11 to about 13.5 wherein said acid passivating agent comprises at least one alkaline earth metal compound and optionally a second metal compound.

2. A process comprising: (1) contacting a metal-containing material with an aqueous solution which comprises (a) manganate ions or a precursor of manganate ions and (b) a base to produce a third combination; (2) contacting said third combination with an acid passivating agent to produce a fourth combination; and (3) maintaining the pH of said fourth combination in the range of about 11 to about 13.5 wherein said acid passivating agent comprises at least one alkaline earth metal compound and optionally a second metal compound.

3. A process for limiting acid rock drainage from sulfidic iron-containing rock comprising (1) contacting a metal-containing material with an acid passivating agent to produce a first combination; (2) contacting said first combination with an aqueous solution which comprises (a) manganate ions or a precursor of manganate ions and (b) a base to produce a second combination; and (3) maintaining the pH of said second combination in the range of about 11 to about 13.5 wherein said acid passivating agent comprises at least one alkaline earth metal compound and optionally a second metal compound.

4. A process according to claim 1, claim 2, or claim 3 wherein said metal-containing material comprises iron and sulfide and said process produces a pretreated ore or rock.

5. A process according to claim 1, claim 2, or claim 3 wherein said acid passiviating agent further comprises a second metal and the metal of said second metal compound is selected from the group consisting of Ag, Cd, Ge, Mg, Pd, Pt, V, Zn, and combinations of two or more thereof and said process produces a pretreated ore or rock.

6. A process according to claim 4 wherein said acid passivating agent is selected from the group consisting of alkaline earth metal oxide, alkaline earth metal hydroxide, and combinations thereof.

7. A process according to claim 4 wherein said acid passivating agent is selected from the group consisting of magnesium compound, calcium oxide, calcium hydroxide, and combinations of two or more thereof.

8. A process according to claim 7 wherein said acid passivating agent further comprises a second metal compound selected from the group consisting of silver compound, cadmium compound, magnesium compound, zinc compound, palladium compound, and combinations thereof.

9. A process according to claim 8 wherein said acid passivating agent is calcium oxide or lime.

10. A process according to claim 5 wherein said acid passivating agent is magnesium oxide and calcium oxide.

11. A process according to claim 10 wherein said second metal compound is a zinc compound.

12. A process according to claim 11 wherein said precursor of manganate ions is potassium permanganate.

13. A process according to claim 4 wherein said pH is in the range of from about 11.5 to about 13.

14. A process according to claim 11 wherein said pH is in the range of from about 11.5 to about 13.

15. A process according to claim 13 further comprising contacting said pretreated ore with a lixiviating agent.

16. A process according to claim 14 further comprising contacting said pretreated ore with a lixiviating agent.

* * * * *